US005893505A

United States Patent [19]

Mueller

[11] Patent Number: 5,893,505

[45] Date of Patent: Apr. 13, 1999

[54] GUIDE FOR A MATERIAL WEB

[75] Inventor: Wolfgang Mueller, Haydn-Strasse, Germany

[73] Assignee: Voith Sulzer Papiermaschinen GmbH, Heidenheim, Germany

[21] Appl. No.: 08/786,104

[22] Filed: Jan. 17, 1997

[30] Foreign Application Priority Data

Jan. 20, 1996 [DE] Germany ..... 196 01 989

[51] Int. Cl.[6] ..... D06F 58/00; F26B 11/02; B65F 20/00

[52] U.S. Cl. ..... 226/97.3; 34/119; 34/120; 242/615.11

[58] Field of Search ..... 226/95, 97.3; 242/615.11; 34/116, 117, 119, 120

[56] References Cited

U.S. PATENT DOCUMENTS

| | | | |
|---|---|---|---|
| 4,628,618 | 12/1986 | Virta et al. | 34/116 |
| 4,669,198 | 6/1987 | Wedel | 34/117 X |
| 4,698,919 | 10/1987 | Wedel | 34/120 X |
| 4,809,445 | 3/1989 | Meyer et al. | 34/120 X |
| 4,893,741 | 1/1990 | Heinzmann . | |
| 4,953,297 | 9/1990 | Eskelinen et al. . | |
| 5,019,213 | 5/1991 | Virta et al. | 34/117 X |
| 5,379,526 | 1/1995 | Haverinen | 34/116 X |
| 5,507,104 | 4/1996 | Skaugen et al. | 34/120 X |

FOREIGN PATENT DOCUMENTS

| | | |
|---|---|---|
| 3504820 | 9/1985 | Germany . |
| 3706541 | 9/1988 | Germany . |
| 3739338 | 6/1989 | Germany . |

*Primary Examiner*—Michael Mansen
*Attorney, Agent, or Firm*—Greenblum & Bernstein, P.L.C.

[57] ABSTRACT

An arrangement for guiding a web of material, e.g., a pulp web or paper web, within a web production machine may include at least one web stabilizer extending substantially across an entire width of the web of material. The arrangement may also include at least one blower box located on at least one side of the web stabilizer and positioned in the vicinity of a lateral edge of the paper web. The blower box may be positioned to provide a negative pressure that substantially reduces web fluttering and the occurrence of web breaks due to fluttering.

19 Claims, 4 Drawing Sheets

GUIDE FOR A MATERIAL WEB

CROSS-REFERENCE OF RELATED APPLICATION

The present invention claims the priority under 35 U.S.C. § 119 of German Patent Application No. 196 01 989.3 filed on Jan. 20, 1996.

BACKGROUND OF THE INVENTION

1. Field of the Invention

The present invention relates to an arrangement for guiding a web of material, particularly a pulp web, within a web production machine. The arrangement may include at least one web stabilizer extending substantially across a width of the web of material, and at least one blower box positioned on at least one side of the web stabilizer and located within a vicinity of a lateral edge of the material web.

2. Discussion of the Background Information

Devices generally utilized for guiding a material web are known and discussed in, e.g., DE 35 04 820 A1. These devices are used to guide a web of material within a web production machine to safely prevent web flutter or web breaks. However, the devices of the prior art have not been able to ensure optimal sealing of the arrangement for guiding the web material.

SUMMARY OF THE INVENTION

For this reason, it is the task of the invention to create an arrangement of the type cited in the beginning that does not have these disadvantages.

To solve this problem, an arrangement for guiding a web of material, e.g., a pulp web, within a web material production machine. The arrangement may include at least one web stabilizer extending substantially across the width of the web of material and at least one blower box located on one side of the web stabilizer in the vicinity of a lateral edge of the web of material. Because the present arrangement for guiding the web of material includes at least one blower box mounted in the vicinity of the lateral web edge, the present invention may attain optimal sealing. Further, the blower box may be precisely arranged and adapted to the run of the web of material and, thus, independent of the web stabilizer. Specifically, the blower box may be arranged, depending on the path of a transport belt guiding the web of material through the production machine, to ensure an optimal seal from the surroundings. Accordingly, the web edges may be fixed on the transport belt that fluttering is rendered practically impossible, which is particularly advantageous at high speeds.

In a preferred embodiment of the present arrangement, the at least one blower box may have a multi-part design. Thus, the individual elements of the blower box may be arranged or adjusted independent of each other to ensure an optimal seal against the surroundings.

Accordingly, the present invention may be directed to an arrangement for guiding a web of material within a web producing machine. The arrangement may include at least one web stabilizer extending substantially across a width of the web of material and at least one blower box located on at least one side of the at least one web stabilizer and positioned within a vicinity of a lateral web edge.

In accordance with another feature of the present invention, the at least one web stabilizer may include a first and second end and at least one blower box may be located at each of the first and second end.

In accordance with still another feature of the present invention, the at least one blower box may include a multi-part design.

In accordance with a further feature of the present invention, the at least one blower box may be located at at least one of a beginning and an end of a free draw.

In accordance with a still further feature of the present invention, the arrangement may include an air supply for the at least one blower box. The air supply may include at least one of air suctioned off from the web stabilizer and air from a separate compressed air supply device.

The present invention may be directed to a web production machine producing a web of material in which the web of material may be guided through the web production machine. The web production machine may include a transport belt guiding the web through a free draw and at least one blower box positioned substantially adjacent an edge of the web.

In accordance with another feature of the present invention, the web producing machine may also include at least one web stabilizer having a first and second end, the at least one blower box coupled to at least one of the first and second end.

In accordance with a further feature of the present invention, the at least one web stabilizer may also include an air deflection device removing air currents from the free draw.

In accordance with a still further feature of the present invention, the at least one web stabilizer may be positioned adjacent to a first and second free draw.

In accordance with yet another feature of the present invention, the at least one blower box may include at least one air intake duct.

In accordance with still another feature of the present invention, the at least one blower box may include at least two blower boxes, the at least two blower boxes may extend along an entire extent of the free draw.

In accordance with a further feature of the present invention, the web producing machine may also include a negative pressure space formed between the at least one blower box and the transport belt. The at least one blower box may include an air outlet slit directing air into the negative pressure space.

In accordance with yet another feature of the present invention, the at least one blower box may include an air supply coupled to one of a suction device and an air compressor.

In accordance with still another feature of the present invention, the at least one blower box may further include an air outlet slit formed by a bent housing section to guide air out of the at least one blower box. The air guided out of the at least one blower box pulls the edge of the web to the transport belt.

In accordance with a further feature of the present invention, the at least one blower box may be adjustable with respect to the transport belt. Further, the web producing machine may include at least one web stabilizer, the at least one blower box coupled to, and adjustable with respect to, the at least one web stabilizer.

In accordance with another feature of the present invention, the web producing machine may include at least one dryer cylinder and at least one guide roll. The free draw may be formed between the at least one dryer cylinder and the at least one guide roll.

In accordance with still another feature of the present invention, the one dryer cylinder and the one guide roll may include substantially similar diameters. Alternatively, the one dryer cylinder and the one guide roll may include substantially different diameters.

In accordance with yet another feature of the present invention, the web producing machine also including a plurality of dryer cylinders, the free draw formed between at least two of the plurality of dryer cylinders.

Further embodiments and advantages can be seen from the detailed description of the present invention and the accompanying figures.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

The arrangement described below for guiding a web material may be universally applicable in a web material production machine. However, while the present invention is described in terms of a paper web production machine, this discussion is intended as explanatory and, therefore, is not intended as limiting the environment in which the present invention may be practiced.

Figure 1:
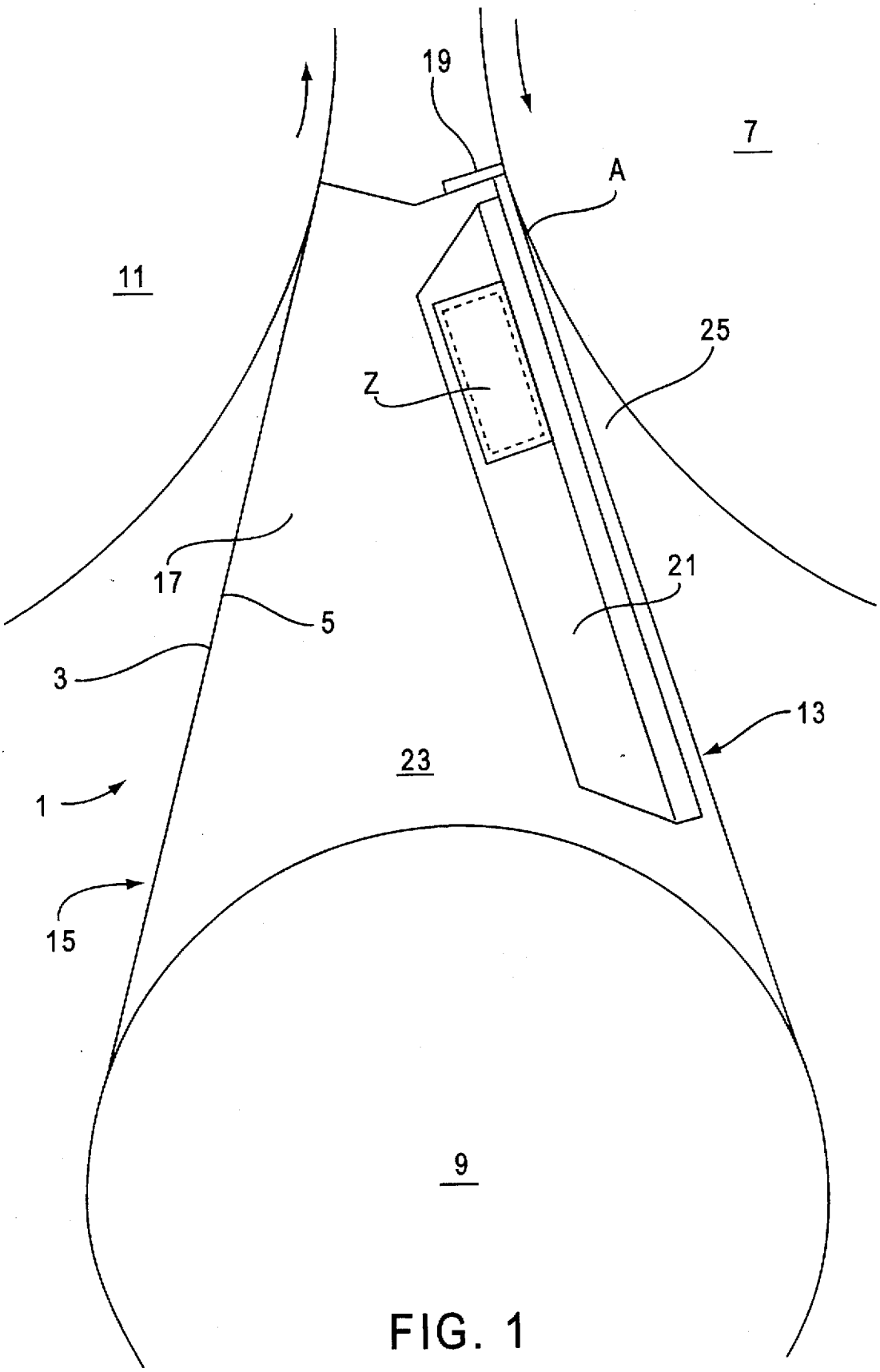
FIG. 1 illustrates a first embodiment of an arrangement for guiding a web of material from a dryer cylinder to a guide roll and from the guide roll to another dryer cylinder.

FIG. 1 shows a portion of a dryer section of a web production machine, e.g., a paper production machine. Within the dryer section an arrangement 1 may be located for guiding a web of material 3, e.g., a paper web, and a transport belt 5. Transport belt 5 may guide web 3 from a first dryer cylinder 7, around a guide roll 9, and to a second dryer cylinder 11. Transport belt 5 and web 3 may be arranged such that web 3 may directly abut (or rest on) the surface of dryer cylinders 7, 11 and transport belt 5 may directly abut guide roll 9. A first free draw 13 may be located between first dryer cylinder 7 and guide roll 9 and a second free draw 15 may be located between guide roll 9 and the second dryer cylinder 11. A web stabilizer 17 may be located between free draws 13 and 15 and may comprise, e.g., a suction box to suction the areas of free draws 13 and 15 and, optionally, to suction guide roll 9. The web stabilizer 17 may be utilized to stabilize web 3 on transport belt 5 in the area of free draws 13 and 15. If guide roll 9 is to be suctioned by web stabilizer 17, then web 3, running around the outer surface of guide roll 9 on transport belt 5, may be suctioned to transport belt 5 and stabilized. Web stabilizer 17 may also be comprised of, e.g., a transfer foil or an air conduction box for transferring web 3 from first dryer cylinder 7 to guide roll 9 and/or from guide roll 9 to second dryer cylinder 11. Further, web stabilizer 17 may be acted on with negative and/or excess pressure or blast air for transferring web 3.

In the embodiment shown in FIG. 1, first dryer cylinder 7 may be assumed to run, e.g., counter clockwise and second dryer cylinder 11 may be assumed to correspondingly run counter clockwise. Guide roll 9, positioned between the dryer cylinders, may be assumed to correspondingly run clockwise. Consequently, an overhead fixture, e.g., an air conducting device 19, may be provided near a point A where transport belt 5 and web 3 are lifted off of the surface of dryer cylinder 7. Air conducting device 19 may remove or deflect air that has been carried along by movement of transport belt 5 and web 3, so that the air will not enter into the area of web stabilizer 17 and adversely affect the operation of the present invention.

Web stabilizer 17 may extend substantially across the entire width of the paper web 3. Preferably, a blower box 21 may be provided in an area adjacent to each of the edges of paper web 3. Blower box 21, shown in FIG. 1, may be attached to a side wall 23 of web stabilizer 17 in such a manner that blower box 21 may be adjusted and/or regulated independently of web stabilizer 17. Blower box 21 may be coordinated with a nip 25, formed where paper web 3 is separated from the outer surface of dryer cylinder 7. Blower box 21 may include an air intake connection Z and may have at least one blow nozzle directed (opened) toward transport belt 5. Blower box 21 may be provided with air supplied from, e.g., air suctioned off by the web stabilizer which can be constructed as, e.g., suction box. Alternatively, the air may be supplied by a separate compressed air supply device, e.g., a compressor. In the preferred embodiment, the arrangement for blower box 21 may be provided with air suctioned off from web stabilizer 17. This particular embodiment simplifies the structure of the dryer section and ensures a safe transfer of paper web 3 from dryer cylinder 7 to guide roll 9, even at high production speeds.

Figure 2:
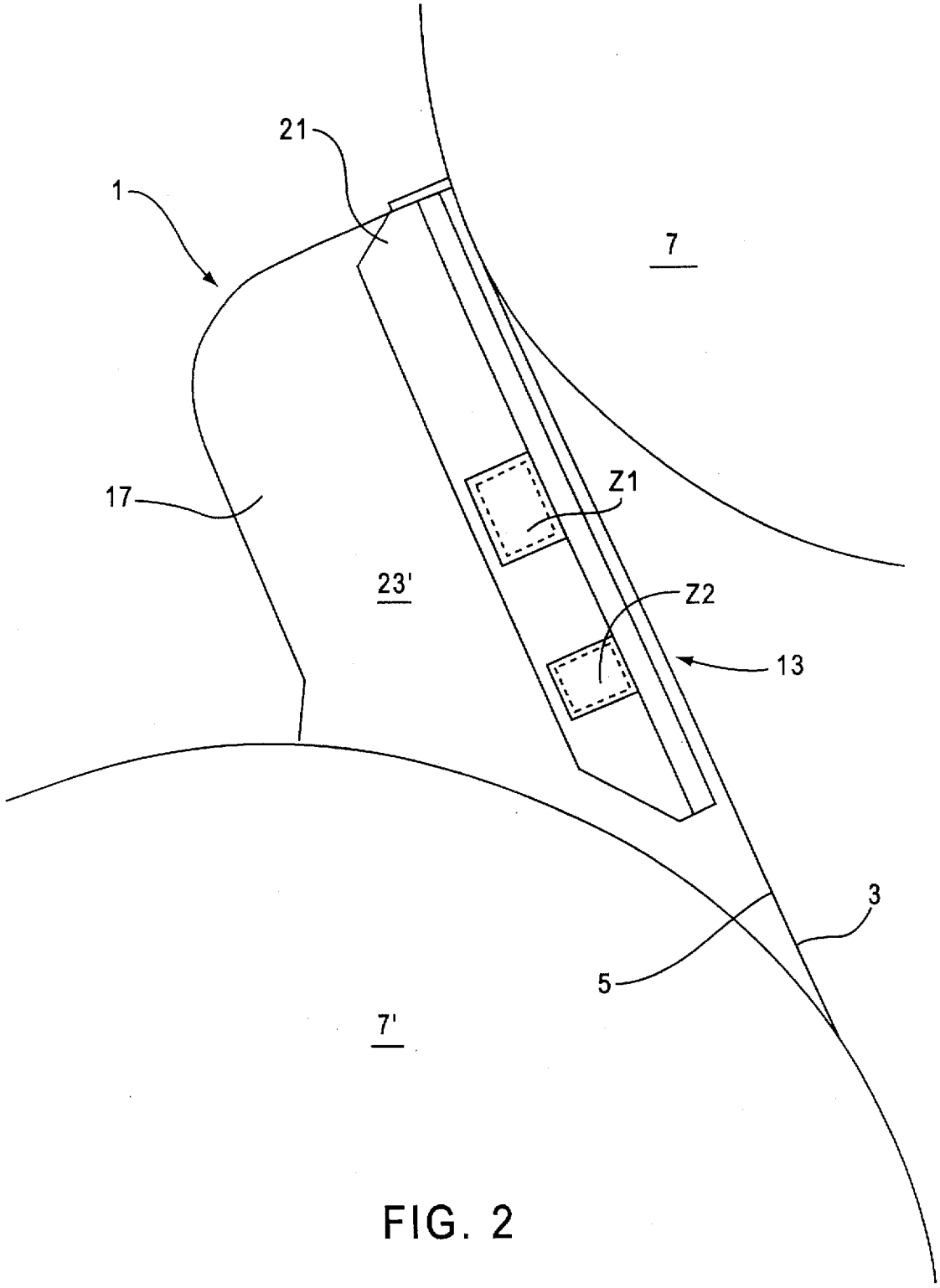
FIG. 2 illustrates a second embodiment of an arrangement for guiding a web of material around at least two dryer cylinders.

FIG. 2 shows an alternative embodiment of arrangement 1 for use in a system in which the web of material 3 may be transferred from, e.g., a dryer cylinder 7 to a second dryer cylinder 7'. The cylinders around which paper web 3 is guided, with transport belt 5, may have the same diameter. Free draw 13, positioned between the two dryer cylinders 7 and 7', may be assigned a web stabilizer 17, however, the web stabilizer only acts on one free draw, e.g., between dryer cylinder 7 and dryer cylinder 7'.

As with the embodiment of FIG. 1, web stabilizer 17 may extend across the entire width of the paper production machine. Web stabilizer 17 may include a lateral wall 23' and a blower box 21. Blower box 21 may be attached to lateral wall 23' and may be arranged in the vicinity of the edge of paper web 3. Blower box 21 may also include a plurality of air connections, e.g., air connections Z1 and Z2.

Blower boxes 21, shown in FIGS. 1 and 2, may each be located along the sides (edges) of transport belt 5 and may each stabilize paper web 3 as it is guided on transport belt 5.

Figure 3:
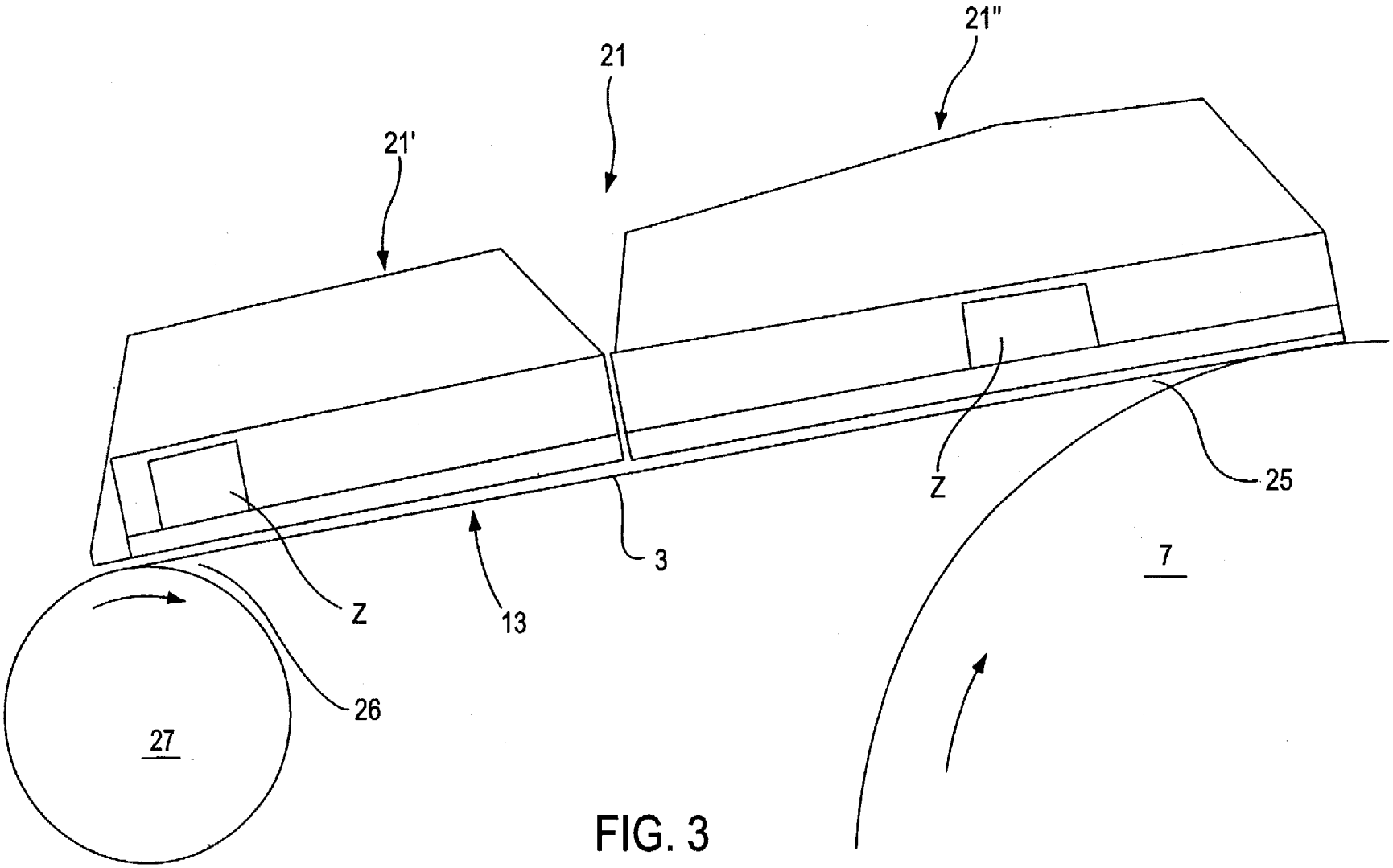
FIG. 3 illustrates a third embodiment of an arrangement for guiding a web of material from a deflecting roll to a dryer cylinder.

FIG. 3 shows a section a machine for producing a web of material in which a web of material 3 is guided across two rolls. For example, the web of material 3 can be guided from a deflecting roll 27 to a dryer cylinder 7. The diameter of the dryer cylinder may be considerably greater than the diameter of deflecting roll 27. Deflecting roll 27 may serve, e.g., as guide roll. It is also conceivable that deflecting roll 27 may be heated. In the embodiment depicted in FIG. 3, it is preferred that blower box 21 is located across and along free draw 13. Blower box 21 may include several parts, e.g., a first partial blower box 21' and a second partial blower box 21". It is also conceivable to use a plurality of small web stabilizers to guide web of material 3 in the vicinity of free draw 13.

Each of the partial blower boxes 21' and 21" may include an air intake connection Z. As with the previously described embodiments, blower box 21 may be arranged in the vicinity of an edge of web of material 3. Blower box 21 of FIG. 3 may be distinguished from those shown in FIGS. 1 and 2 in that blower box 21 may extend across the entire length of free draw 13. Thus, blower box 21 may act as a run-off nip 26 at deflection roll 27 and as a run-on nip 25 at dryer cylinder 7. However, due to the air carried along by dryer cylinder 7 and web of material 3, excess pressure may exist at nip 25.

Depending on the flutter behavior of web of material 3, the embodiment of FIG. 3 may omit one of the partial blower boxes 21' and 21" so that only run-off nip 26 or run-on nip 25 may be subject to a stabilizing or guiding of the web of material.

Figure 4:
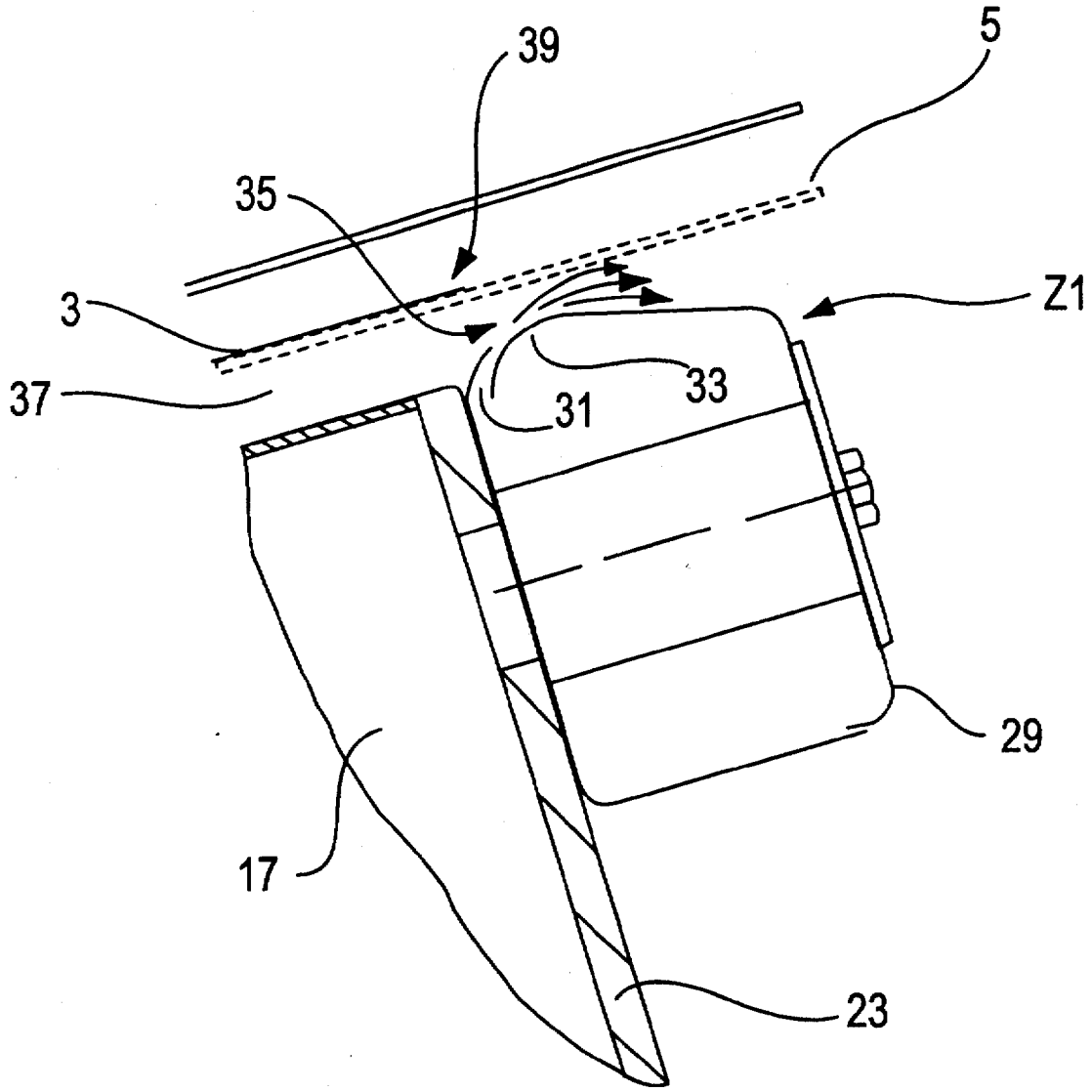
FIG. 4 illustrates a cross section through a web stabilizer and a blower box utilized in each of the embodiments of FIGS. 1–3.

FIG. 4 shows a cross section through a blower box 21. Blower box 21 may include a housing 29 that is coupled, in a suitable manner, to an air supply device to ensure excess pressure within the housing 29. Air may exit housing 29 through an outlet slit 31, which may open near a bent housing section 33. Outlet slit 31 may be designed in such a manner that the air flows along the bent housing section 33 and exits through a slit 35 that may be located between housing 29 and transport belt 5. The air may be guided in such a manner, e.g., that a negative pressure is created in a space 37 between web stabilizer 17 and transport belt 5. Alternatively, the negative pressure which may be present due to web stabilizer 17 may be reinforced. Blower box 21 may be arranged in a vicinity of an edge 39 of web of material 3. Thus, the air from blower box 21 may provide particularly safe guidance of web edge 29, e.g., to substantially reduce or eliminate fluttering and, thus, prevent the danger of a web break.

In FIG. 4, transport belt 5 is shown in two discrete positions, i.e.; a continuous line shows a resting position of transport belt 5 and a broken line shows a working position for transport belt 5.

Blower box 21 may be mounted on lateral wall 23 of web stabilizer 17 and may be adjusted and set independently from the web stabilizer in relation to transport belt 5 and web of material 3. The arrangement of outlet slit 31 may be selected in such a manner that the exiting air preferably slides along bent housing section 33 and delineates space 37 safely against the surrounding outside of the paper production machine to build up a negative pressure.

From the above descriptions for FIGS. 1 to 4, it becomes clear that blower boxes 21 may preferably be installed on both sides of web stabilizer 17 to prevent fluttering of the web edge on both sides of the guided web. Because blower boxes 21 are designed separately from web stabilizer 17, blower boxes 21 may be adjusted independently from web stabilizer 17 with regard to transport belt 5 and/or web of material 3, so that a safe negative pressure may be ensured on both sides of web of material 3. If blower box 21 comprises several parts or if several small blower boxes are sequentially arranged sequentially in the area of free draw 13, the blower boxes may be independently adjusted with respect to each other to optimally adjust to the run of transport belt 5 and web of material 3.

Finally, the above statements make it clear that the blower boxes can be working together with web stabilizers of any desired design and can thus be applied universally.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. An arrangement for guiding a web of material within a web producing machine, the arrangement comprising:

at least one web stabilizer extending substantially across a width of the web of material;

at least two blower boxes located on at least one side of the at least one web stabilizer and positioned within a vicinity of a lateral web edge; and the at least two blower boxes being adjustable positionable with respect to the at least one web stabilizer.

2. The arrangement according to claim 1, said at least one web stabilizer comprising a first and second end; and at least one of the at least two blower boxes being located at each of the first and second end.

3. The arrangement according to claim 1, the at least two blower boxes comprising a multi-part design.

4. The arrangement according to claim 1, at least one of the at least two blower boxes being located at at least one of a beginning and an end of a free draw.

5. The arrangement according to claim 1, farther comprising an air supply for the at least two blower boxes, the air supply comprising at least one of air suctioned off from the web stabilizer and air from a separate compressed air supply device.

6. A web production machine producing a web of material, the web of material being guided through said web production machine, said web production machine comprising:

a transport belt guiding the web through a free draw; and at least one blower box positioned substantially adjacent an edge of the web; and the at least one blower box being adjustably positionable with respect to the transport belt.

7. The web production machine according to claim 6, further comprising:

at least one web stabilizer comprising a first and second end, said at least one blower box coupled to at least one of said first and second end.

8. The web production machine according to claim 7, said at least one web stabilizer further comprising an air deflection device removing air currents from said free draw.

9. The web production machine according to claim 7, said at least one web stabilizer positioned adjacent to a first and second free draw.

10. The web production machine according to claim 6, said at least one blower box comprising at least one air intake duct.

11. The web production machine according to claim 6, said at least one blower box comprising at least two blower boxes, said at least two blower boxes extending along an entire extent of said free draw.

12. The web production machine according to claim 6, further comprising a negative pressure space formed between said at least one blower box and said transport belt;

said at least one blower box comprising an air outlet slit directing air into-said negative pressure space.

13. The web production machine according to claim 6, said at least one blower box comprising an air supply coupled to one of a suction device and an air compressor.

14. The web production machine according to claim 13, said at least one blower box further comprising an air outlet slit formed by a bent housing section to guide air out of said at least one blower box; and said air guided out of said at least one blower box pulls said edge of the web to said transport belt.

15. The web production machine according to claim 6 further comprising at least one web stabilizer, said at least one blower box coupled to, and adjustable with respect to, said at least one web stabilizer.

16. The web production machine according to claim 6, further comprising at least one dryer cylinder and at least one guide roll, said free draw formed between said at least one dryer cylinder and said at least one guide roll.

17. The web production machine according to claim 16, said one dryer cylinder and said one guide roll comprising substantially similar diameters.

18. The web production machine according to claim 16, said one dryer cylinder and said one guide roll comprising substantially different diameters.

19. The web production machine according to claim 6, further comprising a plurality of dryer cylinders, said free draw formed between at least two of said plurality of dryer cylinders.

* * * * *